US010871732B2

(12) United States Patent
Konishi et al.

(10) Patent No.: US 10,871,732 B2
(45) Date of Patent: Dec. 22, 2020

(54) DEVIATION DETECTION DEVICE, BELT DEVICE, AND IMAGE FORMING APPARATUS INCLUDING SAME

(71) Applicants: Takahiro Konishi, Tokyo (JP); Tomoaki Suga, Kanagawa (JP)

(72) Inventors: Takahiro Konishi, Tokyo (JP); Tomoaki Suga, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/581,983

(22) Filed: Sep. 25, 2019

(65) Prior Publication Data

US 2020/0133172 A1 Apr. 30, 2020

(30) Foreign Application Priority Data

Oct. 30, 2018 (JP) ..... 2018-203507

(51) Int. Cl.

*G03G 15/16* (2006.01)
*G03G 15/08* (2006.01)
*G03G 15/00* (2006.01)

(52) U.S. Cl.

CPC ..... *G03G 15/1615* (2013.01); *G03G 15/0808* (2013.01); *G03G 15/751* (2013.01); *G03G 2215/0129* (2013.01); *G03G 2215/0158* (2013.01)

(58) Field of Classification Search

CPC ..... G03G 2215/00143–00168
See application file for complete search history.

(56) References Cited

U.S. PATENT DOCUMENTS

| | | | | |
|---|---|---|---|---|
| 2014/0147160 | A1 | 5/2014 | Konishi | |
| 2015/0043928 | A1 | 2/2015 | Konishi et al. | |
| 2015/0346643 | A1 | 12/2015 | Konishi et al. | |
| 2016/0231562 | A1 | 8/2016 | Suga | |
| 2020/0064765 | A1* | 2/2020 | Suga | G03G 15/5054 |

FOREIGN PATENT DOCUMENTS

| | | | |
|---|---|---|---|
| JP | 62151703 A | * | 7/1987 |
| JP | 2011-033827 | | 2/2011 |
| JP | 2012-093776 | | 5/2012 |

* cited by examiner

*Primary Examiner* — Sevan A Aydin
(74) *Attorney, Agent, or Firm* — Harness, Dickey & Pierce, P.L.C.

(57) ABSTRACT

A deviation detection device to detect a deviation of a rotator includes a contact member disposed in contact with the rotator and configured to move, following a deviation of the rotator in a width direction of the rotator. The deviation detection device further includes a deviation detector configured to detect a direction of the deviation and a deviation amount of the rotator based on a displacement of the contact member, and a wear detector configured to detect a state in which an amount of wear of the contact member has reached a threshold.

9 Claims, 6 Drawing Sheets

DEVIATION DETECTION DEVICE, BELT DEVICE, AND IMAGE FORMING APPARATUS INCLUDING SAME

CROSS-REFERENCE TO RELATED APPLICATION

This patent application is based on and claims priority pursuant to 35 U.S.C. § 119(a) to Japanese Patent Application No. 2018-203507, filed on Oct. 30, 2018, in the Japan Patent Office, the entire disclosure of which is hereby incorporated by reference herein.

BACKGROUND

Technical Field

Embodiments of the present disclosure relate to a deviation detection device configured to detect a displacement of a rotator in a width direction of the rotator, such as an intermediate transfer belt, a transfer conveyance belt, and a photoconductor belt that rotates in a predetermined direction; a belt device incorporating the deviation detection device, and an image forming apparatus incorporating the deviation detection device.

Description of the Related Art

Image forming apparatuses, such as copiers and printers, generally include a rotator (e.g., an intermediate transfer belt) that rotates in a predetermined direction. There are image forming apparatuses that include a deviation detection device configured to detect a displacement (a deviation) of the rotator in a width direction.

SUMMARY

An embodiment of this disclosure provides a deviation detection device to detect a deviation of a rotator. The deviation detection device includes a contact member disposed in contact with the rotator and configured to move following a deviation of the rotator in a width direction of the rotator, a deviation detector configured to detect a direction of the deviation and a deviation amount of the rotator based on a displacement of the contact member, and a wear detector configured to detect a state in which an amount of wear of the contact member has reached a threshold.

Another embodiment provides a belt device that includes the deviation detection device described above and the rotator that is a belt.

Yet another embodiment provides an image forming apparatus that includes an image forming device configured to form an image, and the belt device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 6A-1 illustrates a configuration of a transmissive photo sensor included in the deviation detection device;

FIG. 6A-2 is a graph illustrating an output change of the transmissive photo sensor illustrated in FIG. 6A-1;

FIG. 6B-1 illustrates the transmissive photo sensor when an intermediate transfer belt is deviated to one side;

FIG. 6B-2 is a graph illustrating an output change of the transmissive photo sensor illustrated in FIG. 6B-1;

FIG. 6C-1 illustrates the transmissive photo sensor when the intermediate transfer belt is deviated to the other side;

FIG. 6C-2 is a graph illustrating an output change of the transmissive photo sensor illustrated in FIG. 6C-1;

Figure 1:
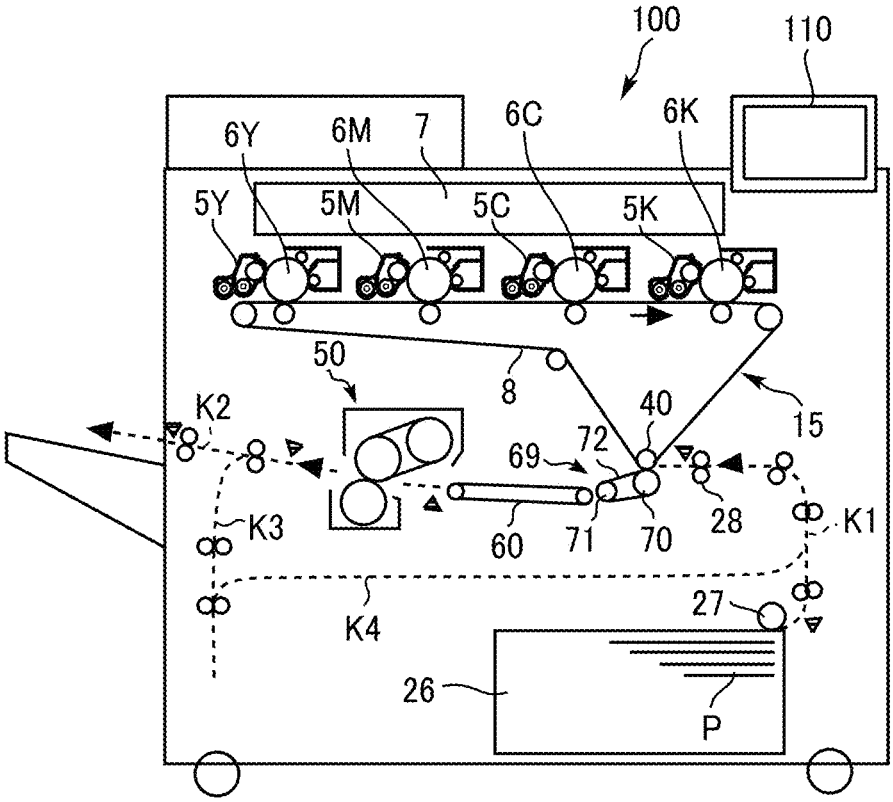
FIG. 1 is a schematic view illustrating a configuration of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

The suffixes Y, M, C, and K attached to each reference numeral indicate only that components indicated thereby are used for forming yellow, magenta, cyan, and black images, respectively, and hereinafter may be omitted when color discrimination is not necessary.

Figure 2:
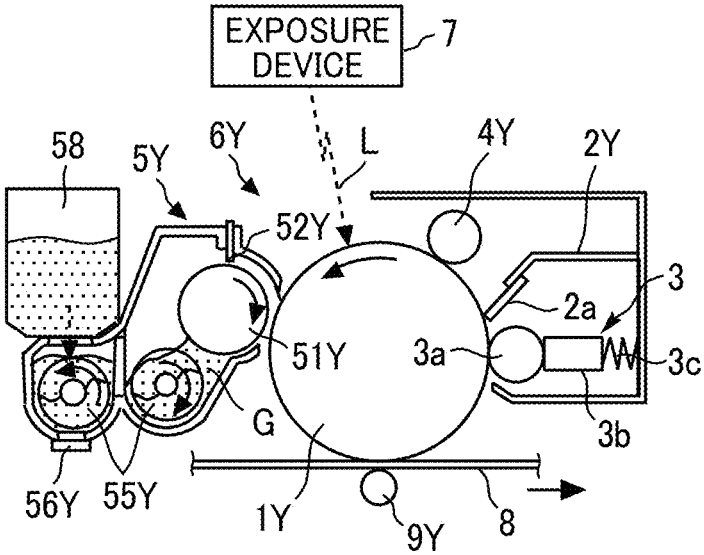
FIG. 2 is a schematic cross-sectional view of an image forming unit of the image forming apparatus in FIG. 1.

With Reference to FIGS. 1 and 2, a configuration and operation of an image forming apparatus 100 is described below.

FIG. 1 is a schematic view illustrating the configuration of the image forming apparatus 100, which in the present embodiment is a printer. FIG. 2 is an enlarged schematic view illustrating a part of an image forming unit 6Y (an image forming device) of the image forming apparatus 100.

As illustrated in FIG. 1, the image forming apparatus 100 includes an intermediate transfer belt device 15 as a belt device (a belt conveyor) at the center of an apparatus body of the image forming apparatus 100. Image forming units 6Y, 6M, 6C, and 6K corresponding to yellow, magenta, cyan, and black, respectively, are arranged in parallel, facing an intermediate transfer belt 8 (a rotator) of the intermediate transfer belt device 15. Below the intermediate transfer belt device 15, a secondary transfer belt device 69 is disposed.

With reference to FIG. 2, the image forming unit 6Y for yellow includes a photoconductor drum 1Y and further includes a charging device 4Y, a developing device 5Y, a cleaning device 2Y, a lubricant supply device 3, and a discharger disposed around the photoconductor drum 1Y. Image forming processes, namely, charging, exposure, development, transfer, and cleaning processes, are performed on the photoconductor drum 1Y, and thus a yellow toner image is formed on a surface of the photoconductor drum 1Y.

The other image forming units 6M, 6C, and 6K have a similar configuration to that of the yellow image forming unit 6Y except that the colors of the toner used therein are different and form magenta, cyan, and black toner images, respectively. Thus, only the image forming unit 6Y is described below and descriptions of the other three image forming units 6M, 6C, and 6K are omitted.

With reference to FIG. 2, the photoconductor drum 1Y is rotated counterclockwise in FIG. 2 by a main motor. The charging device 4Y uniformly charges the surface of the photoconductor drum 1Y at a position opposite the charging device 4Y (a charging process).

Then, the charged surface of the photoconductor drum 1Y reaches a position to receive a laser beam L emitted from an exposure device 7, and the photoconductor drum 1Y is scanned with the laser beam L in a width direction at the position, thereby forming an electrostatic latent image for yellow on the surface of the photoconductor drum 1Y (an exposure process). The width direction is a main-scanning direction perpendicular to the surface of the paper on which FIGS. 1 and 2 are drawn.

The surface of the photoconductor drum 1Y carrying the electrostatic latent image reaches a position opposite the developing device 5Y, and the electrostatic latent image is developed into a toner image of yellow at the position (a development process).

When the surface of the photoconductor drum 1Y carrying the toner image reaches a position opposite a primary transfer roller 9Y via the intermediate transfer belt 8, the toner image on the surface of the photoconductor drum 1Y is transferred onto a surface of the intermediate transfer belt 8 at the position (a primary transfer process). After the primary transfer process, a certain amount of untransferred toner remains on the photoconductor drum 1Y.

When the surface of the photoconductor drum 1Y reaches a position opposite the cleaning device 2Y, a cleaning blade 2*a* collects the untransferred toner from the photoconductor drum 1Y into the cleaning device 2Y (a cleaning process).

The cleaning device 2Y includes a lubricant supply roller 3*a*, a solid lubricant 3*b*, and a compression spring 3*c*, which constitute a lubricant supply device 3 for the photoconductor drum 1Y. The lubricant supply roller 3*a* rotating clockwise in FIG. 2 scrapes a small amount of lubricant from the solid lubricant 3*b* and applies the lubricant to the surface of the photoconductor drum 1Y.

Subsequently, a discharger removes residual potentials from the photoconductor drum 1Y.

Thus, a sequence of image forming processes performed on the photoconductor drum 1Y is completed.

The above-described image forming processes are performed in the image forming units 6M, 6C, and 6K similarly to the yellow image forming unit 6Y. That is, the exposure device 7 disposed above the image forming units 6M, 6C, and 6K irradiates the photoconductor drums 1M, 1C, and 1K of the image forming units 6M, 6C, and 6K with the laser beams L based on image data. Specifically, the exposure device 7 includes a light source to emit the laser beams L, multiple optical elements, and a polygon mirror that is rotated by a motor. The exposure device 7 scans, with the laser beams L, the photoconductor drums 1M, 1C, and 1K via the multiple optical elements while deflecting the laser beams L with the polygon mirror. Alternatively, an exposure device 7 in which a plurality of light-emitting diodes (LEDs) is arranged side by side in the width direction can be used.

Then, the toner images formed on the photoconductor drums 1M, 1C, and 1K through the development process of the developing devices 5M, 5C, and 5K are primarily transferred therefrom and superimposed onto the intermediate transfer belt 8. Thus, a multicolor toner image is formed on the intermediate transfer belt 8.

Figure 3:
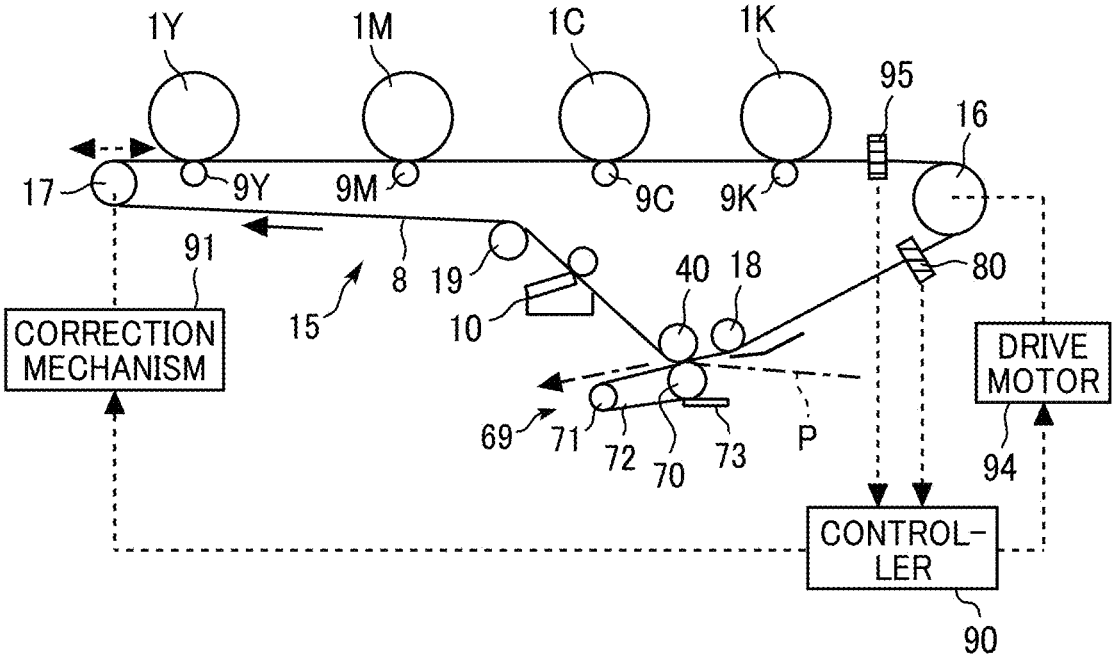
FIG. 3 is a schematic view of a belt device of the image forming apparatus in FIG. 1.

The intermediate transfer belt 8 as the rotator is stretched and supported around a plurality of rollers 16 through 19 and 40 and is rotated by the drive roller 16 driven by a drive motor 94 in a direction indicated by an arrow in FIG. 3.

The four primary transfer rollers 9Y, 9M, 9C, and 9K are pressed against the corresponding photoconductor drums 1Y, 1M, 1C, and 1K, respectively, via the intermediate transfer belt 8 to form primary transfer nips. Transfer voltages (primary transfer biases) opposite in polarity to that of toner are applied to the primary transfer rollers 9Y, 9M, 9C, and 9K.

While rotating in the direction indicated by arrow Y2 in FIG. 3, the intermediate transfer belt 8 passes through the primary transfer nips between the photoconductor drums 1Y, 1M, 1C, and 1K and the respective primary transfer rollers 9Y, 9M, 9C, and 9K. Then, the single-color toner images are primarily transferred from the photoconductor drums 1Y, 1M, 1C, and 1K and superimposed one on another onto the intermediate transfer belt 8, thereby forming the multicolor toner image on the intermediate transfer belt 8 (a primary transfer process).

Then, the intermediate transfer belt 8 carrying the multicolor toner image reaches a position opposite a secondary transfer belt 72. At that position, the secondary-transfer backup roller 40 press against the secondary transfer roller 70 via the intermediate transfer belt 8 and the secondary transfer belt 72, thereby forming the secondary transfer nip. The multicolor (four-color) toner image on the intermediate transfer belt 8 is transferred onto a sheet P (e.g., a paper sheet) conveyed to the secondary transfer nip (a secondary transfer process). At that time, toner that is untransferred onto the sheet P remains on the surface of the intermediate transfer belt 8.

Then, the intermediate transfer belt 8 reaches a position opposite a belt cleaner 10. At this position, the belt cleaner 10 removes substances adhering to the intermediate transfer belt 8 (e.g., untransferred toner).

Thus, a sequence of image forming processes performed on the intermediate transfer belt 8 is completed.

With reference to FIG. 1, the sheet P is conveyed from a sheet feeder 26 disposed in a lower portion of the apparatus body of the image forming apparatus 100 to the secondary transfer nip via a feed roller 27 and a registration roller pair 28.

Specifically, the sheet feeder 26 contains a stack of multiple sheets P such as paper sheets piled one on another. As the feed roller 27 rotates counterclockwise in FIG. 1 the topmost sheet P of the stack of multiple sheets P in the sheet feeder 26 is fed toward a nip between the registration roller pair 28 via a first conveyance passage K1.

The registration roller pair 28 (a timing roller pair) temporarily stops rotating, stopping the sheet P with a leading edge of the sheet P nipped between the registration roller pair 28. The registration roller pair 28 rotates to convey the sheet P to the secondary transfer nip, timed to coincide with the arrival of the multicolor toner image on the intermediate transfer belt 8. Thus, the desired multicolor toner image is transferred onto the sheet P.

The sheet P, onto which the multicolor toner image is secondarily transferred at the secondary transfer nip, is conveyed on the secondary transfer belt 72 and separated from the secondary transfer belt 72, and then a conveyance belt 60 conveys the sheet P to a fixing device 50. In the fixing device 50, a fixing belt and a pressing roller apply heat and pressure to the sheet P to fix the multicolor toner image transferred on the sheet P (a fixing process).

The sheet P is conveyed through a second conveyance passage K2 and ejected by an ejection roller pair to the outside of the image forming apparatus 100. The sheets P ejected by the ejection roller pair are sequentially stacked as output images on a stack section to complete a series of image forming processes (printing operations) performed by the image forming apparatus 100.

Thus, in single-side printing, the sheet P is ejected after the toner image is fixed on the front side of the sheet P. By contrast, in duplex printing to form toner images on both sides (front side and back side) of the sheet P, the sheet P is guided to a third conveyance passage K3. After a direction of conveyance of the sheet P is reversed, the sheet is conveyed again to the secondary transfer nip (a secondary transfer belt device 69) via a fourth conveyance passage K4. Then, through the image forming processes (the printing operations) similar to those described above, the toner image is transferred onto the back side of the sheet P at the secondary transfer nip and fixed thereon by the fixing device 50, after which the sheet P is ejected from the image forming apparatus 100 via the second conveyance passage K2.

Next, a detailed description is provided of a configuration and operations of the developing device 5Y of the image forming unit with reference to FIG. 2.

The developing device 5Y includes a developing roller 51Y opposed to the photoconductor drum 1Y, a doctor blade 52Y opposed to the developing roller 51Y, two conveying screws 55Y disposed in a developer storage of the developing device 5Y, and a toner concentration sensor 56Y to detect a toner concentration in the developer. The developing roller 51Y includes stationary magnets, a sleeve that rotates around the magnets, and the like. The developer storage contains two-component developer G including carrier (carrier particles) and toner (toner particles).

The developing device 5Y with such a configuration operates as follows.

The sleeve of the developing roller 51Y rotates in the direction indicated by an arrow illustrated in FIG. 2. The developer G is carried on the developing roller 51Y by a magnetic field generated by the magnets. As the sleeve rotates, the developer G moves along a circumference of the developing roller 51Y. A ratio of toner to carrier (i.e., toner concentration) in the developer G contained in the developing device 5Y is adjusted within a predetermined range. Specifically, when low toner concentration is detected by the toner concentration sensor 56Y disposed in the developing device 5Y, fresh toner is supplied from a toner container 58 to the developing device 5Y to keep the toner concentration within the predetermined range.

The two conveying screws 55Y stir and mix the developer G with the toner supplied from the toner container 58 to the developer storage while circulating the developer G in the developer storage separated into two compartments. In this case, the developer G moves in the direction perpendicular to the surface of the sheet on which FIG. 2 is drawn. The toner in developer G is charged by friction with carrier and electrostatically attracted to the carrier. Then, the toner is carried on the developing roller 51Y together with the carrier by a magnetic force generated on the developing roller 51Y.

The developer G carried on the developing roller 51Y is transported in the direction indicated by the arrow illustrated in FIG. 2 to the doctor blade 52Y. The amount of developer G on the developing roller 51Y is adjusted by the doctor blade 52Y, after which the developer G is carried to a developing range opposed to the photoconductor drum 1Y. The toner in the developer G is attracted to the latent image formed on the photoconductor drum 1Y due to the effect of an electrical field generated in the developing range. As the sleeve rotates, the developer G remaining on the developing roller 51Y reaches an upper part of the developer storage and separates from the developing roller 51Y.

The toner container 58 is detachably (replacably) attached to the developing device 5Y (the image forming apparatus 100). When the toner container 58 runs out of fresh toner, the toner container 58 is detached from the developing device 5Y (the image forming apparatus 100) and replaced with a new one.

A detailed description is given below of the intermediate transfer belt device 15.

Figure 4:
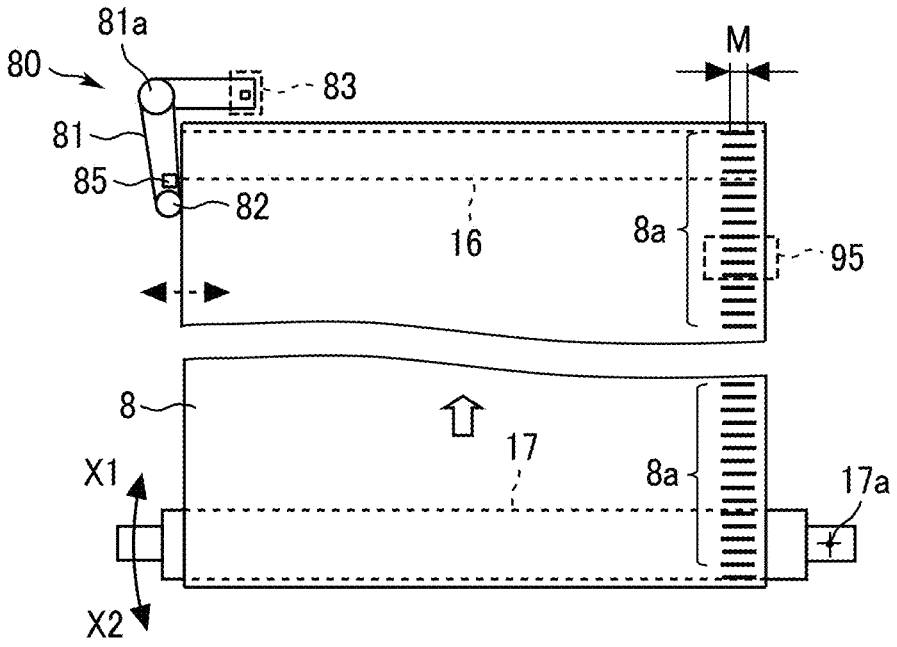
FIG. 4 is a schematic view of a part of the belt device in FIG. 3 as viewed in a width direction of the belt device.

With reference to FIGS. 3 and 4, the intermediate transfer belt device 15 as the belt device includes the intermediate transfer belt 8 (the rotator), the four primary transfer rollers 9Y, 9M, 9C, and 9K, the drive roller 16, a correction roller 17, a correction mechanism 91 (a moving mechanism), a pre-transfer roller 18, a tension roller 19, the belt cleaner 10 for the intermediate transfer belt 8, the secondary-transfer backup roller 40, a deviation detection device 80, and a photo sensor 95 (a speed detector).

The intermediate transfer belt 8 (the rotator) is disposed in contact with the four photoconductor drums 1Y, 1M, 1C, and 1K bearing the toner images of the respective colors to form the primary transfer nips. The intermediate transfer belt 8 is stretched taut around and supported by multiple rollers: the drive roller 16, the correction roller 17, the pre-transfer roller 18, the tension roller 19, the secondary-transfer backup roller 40, and the like.

According to the present embodiment, the intermediate transfer belt 8 is a single-layer or multi-layer belt formed with a material such as polyvinylidene fluoride (PVDF), ethylene tetrafluoroethylene ETFE), polyimide (PI), polycarbonate (PC), and polyamideimide (PAI), and a conductive material such as carbon black is dispersed therein. In the present embodiment, the intermediate transfer belt 8 is a single-layer belt formed with PAI.

The volume resistivity of the intermediate transfer belt 8 is adjusted within a range of from $10^7$ to $10^{12}$ Ω·cm, and the surface resistivity of the back surface of the intermediate transfer belt 8 is adjusted within a range of from $10^8$ to $10^{12}$ Ω/sq. The thickness of the intermediate transfer belt 8 ranges from 80 to 100 μm.

In some embodiments, the intermediate transfer belt 8 may include a release layer coated on the surface of the intermediate transfer belt 8 as needed. Examples of a material usable for the release layer (coating) include, but are not limited to, fluoroplastic such as ET E, polytetrafluoroethylene (PTFE), PVDF, perfluoroalkoxy polymer resin (PFA), tetrafluoroethylene-hexafluoropropylene copolymer (FEP), and polyvinyl fluoride (PVF).

The intermediate transfer belt 8 is manufactured through a casting process, a centrifugal molding process, or the like. The surface of the intermediate transfer belt 8 may be polished as necessary.

The primary transfer rollers 9Y, 9M, 9C, and 9K are disposed in contact with the photoconductor drums 1Y, 1M, 1C, and 1K via the intermediate transfer belt 8, respectively. Specifically, the primary transfer roller 9Y for yellow is disposed in contact with the photoconductor drum 1Y for yellow via the intermediate transfer belt 8. The primary transfer roller 9M for magenta is disposed in contact with the photoconductor drum 1M for magenta via the intermediate transfer belt 8. The primary transfer roller 9C for cyan is disposed in contact with the photoconductor drum 1C for cyan via the intermediate transfer belt 8. The primary transfer roller 9K for black is disposed in contact with the photoconductor drum 1K for black via the intermediate transfer belt 8. Each of the primary transfer rollers 9Y, 9M, 9C, and 9K is an elastic roller including a core and a conductive sponge layer on the core. The volume resistivity of each of the primary transfer rollers 9Y, 9M, 9C, and 9K is adjusted within a range of from $10^6$ to $10^{12}$ Ω·cm, preferably from $10^7$ to $10^9$ Ω·cm.

The drive roller 16 is disposed in contact with an inner circumferential surface of the intermediate transfer belt 8 by an angle of belt winding of about 120 degrees at a position downstream from the four photoconductor drums 1Y, 1M, 1C, and 1K in a direction of rotation of the intermediate transfer belt 8. The drive roller 16 is rotated clockwise in FIG. 3 by the drive motor 94, which is controlled by a controller 90. Such a configuration allows the intermediate transfer belt 8 to rotate in a predetermined direction (i.e., clockwise in FIG. 3) as indicated by an arrow in FIG. 3.

The correction roller 17 is disposed in contact with the inner circumferential surface of the intermediate transfer belt 8 by the angle of belt winding of about 180 degrees at a position upstream from the four photoconductor drums 1Y, 1M, 1C, and 1K in the direction of rotation of the intermediate transfer belt 8. A portion of the intermediate transfer belt 8 extending from the correction roller 17 to the drive roller 16 is arranged approximately horizontal. The correction roller 17 is rotated clockwise in FIG. 3 as the intermediate transfer belt 8 rotates.

The correction roller 17 is coupled to the correction mechanism 91. The correction roller 17 together with the correction mechanism 91 functions as a correction device that corrects a belt deviation (displacement in the width direction) of the intermediate transfer belt 8 based on the result of detection of the deviation of the intermediate transfer belt 8 by the deviation detection device 80. Detailed descriptions of the deviation detection device 80 and the correction device are deferred.

The tension roller 19 is in contact with an outer circumferential surface of the intermediate transfer belt 8. The pre-transfer roller 18 and the secondary-transfer backup roller 40 are in contact with the inner circumferential surface of the intermediate transfer belt 8.

As the intermediate transfer belt 8 rotates, the plurality of rollers 17 through 19 and 40, other than the drive roller 16, is driven to rotate.

The belt cleaner 10 is disposed between the secondary-transfer backup roller 40 and the tension roller 19. The belt cleaner 10 includes a cleaning blade.

With reference to FIG. 3, the secondary-transfer backup roller 40 is in contact with the secondary transfer roller 70 via the intermediate transfer belt 8 and the secondary transfer belt 72, The secondary-transfer backup roller 40 includes a cylindrical core made of, for example, stainless steel and the like, having an elastic layer on an outer circumferential surface of the core. The elastic layer is made of nitrile-butadiene rubber (NBR). The elastic layer has the volume resistivity ranging from approximately $10^7$ to $10^8$ Ω·cm, and a hardness ranging from approximately 48 to 58 degrees on Japanese Industrial Standards (JIS) A hardness (hereinafter "JIS-A hardness") scale. The elastic layer has a thickness of approximately 5 mm.

According to the present embodiment, the secondary-transfer backup roller 40 is electrically connected to a power supply, which applies a high voltage of approximately −5 kV as a secondary transfer bias to the secondary-transfer backup roller 40. With the secondary transfer bias applied to the secondary-transfer backup roller 40, the toner image primarily transferred to the surface of the intermediate transfer belt 8 is secondarily transferred onto the sheet P conveyed to the secondary transfer nip. The secondary transfer bias has the same polarity as the polarity of toner. In the present embodiment, the secondary transfer bias is a direct current voltage and has a negative polarity to transfer the toner image by repulsion. With this configuration, the toner carried on the outer circumferential surface (a surface bearing the toner) of the intermediate transfer belt 8 electrostatically moves from the secondary-transfer backup roller 40 side toward the secondary transfer belt device 69 due to a secondary transfer electrical field.

In another embodiment, the secondary transfer bias may be an alternating current (AC) voltage superimposed on a direct current (DC) voltage. In yet another embodiment, the secondary transfer bias may be applied to the secondary transfer roller 70 to transfer the toner image by attraction.

The secondary transfer belt device 69 includes the secondary transfer belt 72, the secondary transfer roller 70, a separation roller 71, and a secondary-transfer cleaning blade 73.

The secondary transfer belt 72 is an endless belt stretched taut around multiple rollers (i.e., the secondary transfer roller 70 and the separation roller 71). The secondary transfer belt 72 is made of a material similar to that of the intermediate transfer belt 8. The secondary transfer belt 72 is in contact with the intermediate transfer belt 8 to form the secondary transfer nip and conveys the sheet P fed from the secondary transfer nip.

The secondary-transfer backup roller 40 and the secondary transfer roller 70 press against each other via the intermediate transfer belt 8 and the secondary transfer belt 72, thereby forming the secondary transfer nip.

The separation roller 71 is disposed downstream from the secondary transfer nip in the direction of conveyance of the sheet P. Ejected from the secondary transfer nip, the sheet P is conveyed along the secondary transfer belt 72 rotating counterclockwise in FIG. 3 and separated from the secondary transfer belt 72 (curvature separation) at a curved portion of the secondary transfer belt 72 wound around an outer circumference of the separation roller 71 due to self stripping.

The secondary-transfer cleaning blade 73 is in contact with the surface of the secondary transfer belt 72 to remove substances such as toner and paper dust adhering to the surface of the secondary transfer belt 72.

Referring now to FIG. 4, a scale pattern 8*a* is formed in the entire region in the circumferential direction of the intermediate transfer belt 8 according to the present embodiment. The scale pattern 8*a* is disposed at one end in the width direction (which is the lateral direction in FIG. 4) of the intermediate transfer belt 8. The scale pattern 8*a* can be on either the outer surface or the inner surface of the intermediate transfer belt 8. The scale pattern 8*a* includes high-optical-reflectance rectangular pattern portions and low-optical-reflectance rectangular pattern portions that are alternately arranged at equal intervals.

Further, as illustrated in FIGS. 3 and 4, the photo sensor 95 (a reflective photo sensor) including a light-emitting element and a light-receiving element is secured to a position facing the scale pattern 8*a*.

As the scale pattern 8*a* is detected by the photo sensor 95, the speed (a change in speed) of the intermediate transfer belt 8 is detected. In accordance with a result of the detection, the drive motor 94 is adjusted and controlled so that the rotating speed (the running speed) of the intermediate transfer belt 8 becomes constant. For example, when the detection of the scale pattern 8*b* by the photo sensor 95 indicates that the time intervals between detections of the high-optical-reflectance pattern portions are longer than a desired value, the controller 90 determines that the rotating speed of the intermediate transfer belt 8 is lower than a desired value. Therefore, the controller 90 increases the rotating speed of the drive motor 94.

Hereinafter, the deviation detection device 80, which is characteristic in the intermediate transfer belt device 15 (the image forming apparatus 100) according to the present embodiment, is described in detail with reference to FIGS. 3 through 9.

Figure 5:
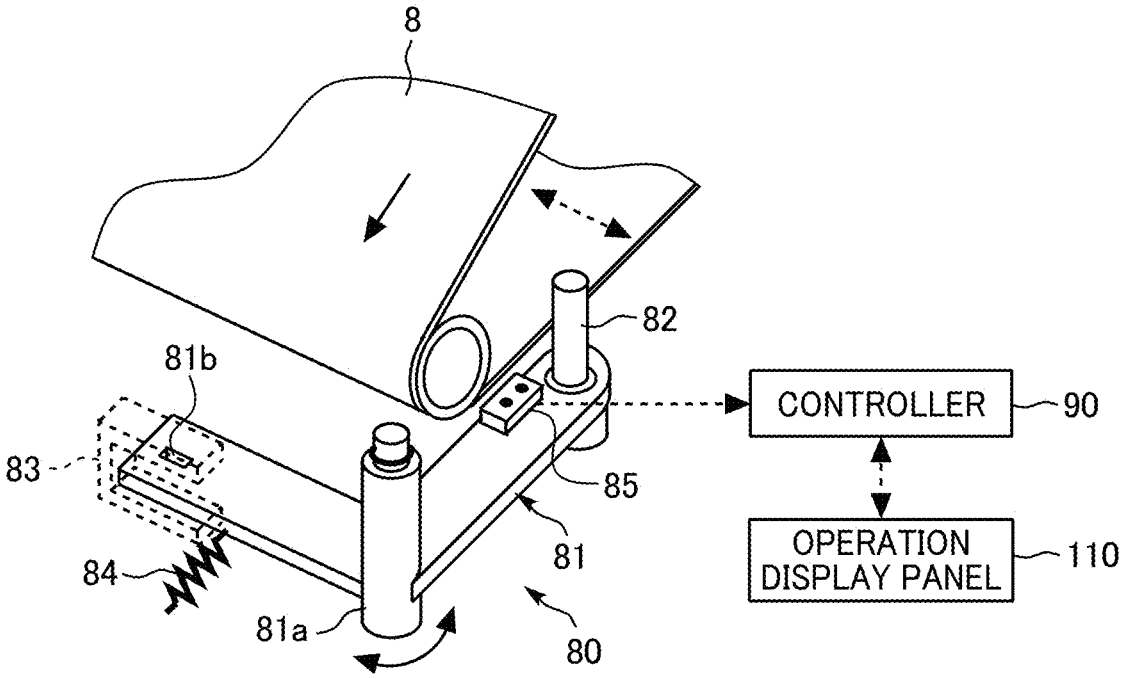
FIG. 5 is a perspective view of a deviation detection device according to an embodiment of the present disclosure.

The intermediate transfer belt device 15 in the present embodiment is a rotator that rotates (running) in a predetermined direction. As illustrated in FIGS. 3 through 5, the intermediate transfer belt device 15 includes the deviation detection device 80 that detects deviation in the width direction (perpendicular to the paper surface on which FIG. 3 is drawn and lateral in FIG. 4) of the intermediate transfer belt 8.

Specifically, referring to FIG. 5, the deviation detection device 80 includes a contact member 82 that contacts the intermediate transfer belt 8, an arm 81 on which the contact member 82 and a wear detection sensor 85 are disposed, and a transmissive photo sensor 83 as a deviation detector that indirectly detects deviations (a deviation direction and a deviation amount) of the intermediate transfer belt 8. The deviation detection device 80 further includes a tension spring 84 as a biasing member and the wear detection sensor 85 as a wear detector. The tension spring 84 biases the arm 81 so that the contact member 82 comes into contact with the intermediate transfer belt 8. The biasing member is not limited to a spring but can be, for example, a sponge that exerts elasticity or a solenoid that exerts an electromagnetic force.

The contact member 82 is in contact with the intermediate transfer belt 8 by biasing force by the tension spring 84 as the biasing member and moves following the displacement of the intermediate transfer belt 8 in the width direction.

Specifically, the contact member 82 is cylindrical and held in a non-rotational manner so as to stand on one end side of the L-shaped arm 81. Further, the contact member 82 is in contact with the intermediate transfer belt 8 such that a longitudinal direction of the contact member 82 is substantially perpendicular to the end in the width direction (i.e., the side end) of the intermediate transfer belt 8. Further, in the present embodiment, the contact member 82 is formed of a metal material having excellent wear resistance such as stainless steel.

The arm 81 is a substantially L-shaped plate made of a resin material and held by the casing of the intermediate transfer belt device 15 so as to be pivotable around a shaft 81*a* in the direction indicated by the solid double arrow in FIG. 5. The cylindrical contact member 82 is secured to one end side of the arm 81 and held by press fit. On the other end side of the arm 81, a slit 81*b* penetrates the arm 81 in the thickness direction.

One end of the tension spring 84 as the biasing member is coupled to the other end side of the arm 81, the side on which the contact member 82 is not disposed. The other end of the tension spring 84 is coupled to the casing of the intermediate transfer belt device 15.

In the present embodiment, the arm 81 and the contact member 82 are individually formed as separated members. Alternatively, the arm 81 and the contact member 82 can be formed as a single piece.

Although the cylindrical contact member 82 is secured on the arm 81 not to rotate in the present embodiment, alternatively, the cylindrical contact member 82 can be rotatably mounted on the arm 81.

Further, in the present embodiment, in addition to the contact member 82, the wear detection sensor 85 (a wear detector) is mounted on the arm 81 so as to protrude in the same height direction. The wear detection sensor 85 will be described in detail later.

With such a configuration, the arm 81 pivots along with the contact member 82 and the wear detection sensor 85 in the direction indicated by solid double arrow in FIG. 5, following the displacement of the intermediate transfer belt 8 in the width direction (the belt deviation direction) indicated by dashed double arrow in FIG. 5.

Specifically, when the intermediate transfer belt 8 shifts to the left in FIG. 4, the contact member 82 and the wear detection sensor 85 moves in the same direction against the biasing force of the tension spring 84, and the arm 81 pivots around the shaft 81*a* clockwise in FIG. 4, On the other hand, when the intermediate transfer belt 8 shifts to the right in FIG. 4, the contact member 82 and the wear detection sensor 85 moves in the same direction by the biasing force of the tension spring 84, and the arm 81 pivots around the shaft 81*a* counterclockwise in FIG. 4.

The transmissive photo sensor 83 as the deviation detector detects a displacement of the contact member 82, thereby indirectly detecting the direction and amount of deviation of the intermediate transfer belt 8 (the rotator) when the intermediate transfer belt 8 moves toward one side (i.e., the belt deviation occurs). In other words, the transmissive photo sensor 83 detects a direction of movement and an amount of movement of the contact member 82 (or the arm 81).

The transmissive photo sensor 83 (the deviation detector) is disposed facing the slit 81*b* in the arm 81. Specifically, with reference to FIGS. 6A-1, 6B-1, and 6C-1, in the present embodiment, the transmissive photo sensor 83 includes one light-emitting element 83*a* and two light-receiving elements 83*b*1 and 83*b*2 disposed across the slit 81*b* of the arm 81. The light-receiving element 83*b*1 is positioned on the right side, and the light-receiving element 83*b*2 is positioned on the left side in FIGS. 6A-1, 6B-1, and 6C-1. The transmissive photo sensor 83 detects the direction of displacement and the amount of displacement of the intermediate transfer belt 8 (,the contact member 82, or the arm 81) based on the change of output of the two light-receiving elements 83*h*1 and 83*b*2.

By using such a transmissive photo sensor 83 as the deviation detector, the cost of the detection device can be reduced as compared with a case in which the deviation detector is a rangefinder or a case in which the deviation detector is a transmissive photo sensor including a plurality of pairs of light-emitting elements and light-receiving elements.

Further, by using such a transmissive photo sensor 83 as the deviation detector, the detection accuracy by the deviation detector can be improved as compared with the case in which the deviation detector is a transmissive photo sensor including one pair of light-emitting element and light-receiving element.

More specifically, the light emitted from the light-emitting element 83*a* spreads radially and enters the two light-receiving elements 83*b*1 and 83*b*2 through the slits 81*b*. The outputs of the light-receiving elements 83*b*1 and 83*b*2 (i.e., sensor outputs) change according to an incident light level from the light-emitting element 83*a*. FIGS. 6A-2, 6B-2, and 6C-2 are graphs illustrating waveforms of the sensor outputs of the light-receiving elements 83*b*1 and 83*b*2. A right side peak of the waveform corresponds to the sensor output of the light-receiving element 83*b*1 positioned on the right side, and a left side peak of the waveform corresponds to the sensor output of the light-receiving element 83*b*2 positioned on the left side in FIGS. 6A-1, 6B-1, and 6C-1.

Figures 1, 6A:
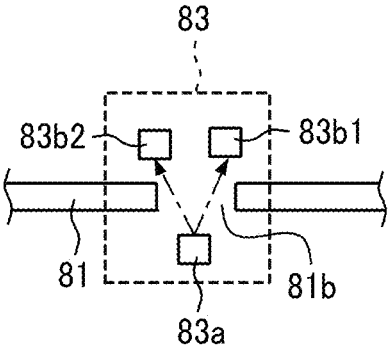
Figures 2, 6A:
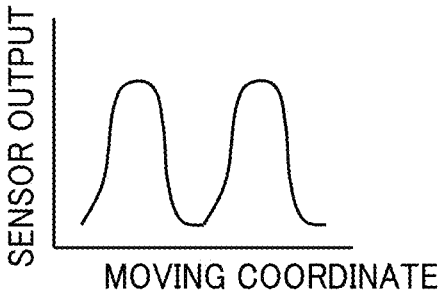

When the intermediate transfer belt 8 is not deviated from the specified position and is in a target posture, that is, when the slit 81*b* of the arm 81 is positioned at the center of the transmissive photo sensor 83 as illustrated in FIG. 6A-1 the light emitted from the light-emitting element 83*a* enters the two light-receiving elements 83*b*1 and 83*b*2 substantially equally. As a result, as illustrated in FIG. 6A-2, the sensor output (voltage) of the two light-receiving elements 83*b*1 and 83*b*2 has an output difference of almost zero. Therefore, when the transmissive photo sensor 83 detects the output waveform as illustrated in FIG. 6A-2, the controller 90 determines that the intermediate transfer belt 8 is not deviated from the specified position (i.e., the belt deviation does not occur).

Figures 1, 6B:
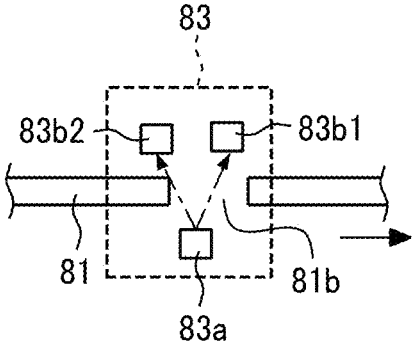
Figures 2, 6B:
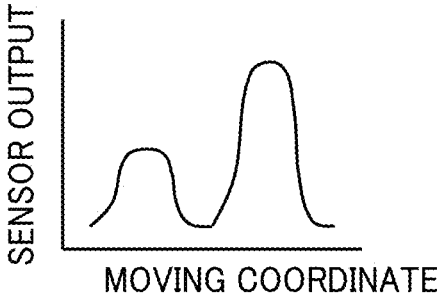

On the other hand, when the intermediate transfer belt 8 is deviated from the specified position toward one end side, that is, when the slit 81*b* of the arm 81 moves to the right indicated by the solid arrow in FIG. 6B-1 relative to the transmissive photo sensor 83, a light incident level on the light-receiving element 83*b*1 on one side (i.e., right side in FIG. 6B-1 is greater than the incident light level on the light-receiving element 83*b*2 on the other side left side in FIG. 6B-1). As a result, as illustrated in FIG. 6B-2, the sensor output of the light-receiving element 83*b*1 on the one side is larger than that of the light-receiving element 83*b*2 on the other side, and an output difference corresponding to the amount of movement of the intermediate transfer belt 8 is generated. Then, when the transmissive photo sensor 83 detects such an output waveform illustrated in FIG. 6B-2, the controller 90 determines the direction of movement and the amount of movement of the arm 81. Accordingly, the direction of movement (or displacement) and the amount of movement (or displacement) of the intermediate transfer belt 8 (or the contact member 82) are obtained.

Figures 1, 6C:
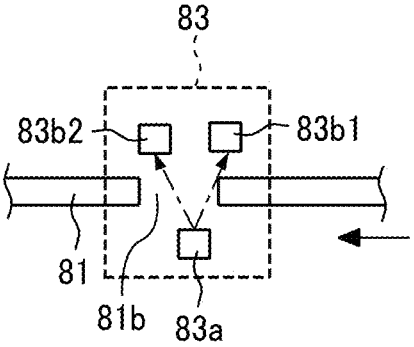
Figures 2, 6C:
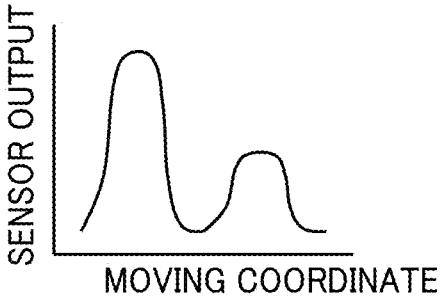

Similarly, when the intermediate transfer belt 8 is deviated from the specified position toward the other end side, that is, when the slit 81*b* of the arm 81 moves to the left indicated by the solid arrow in FIG. 6C-1 relative to the transmissive photo sensor 83, the incident light level on the light-receiving element 83*b*1 on the one side is less than the incident light level on the light-receiving element 83*b*2 on the other side. As a result, as illustrated in FIG. 6C-2, the sensor output of the light-receiving element 83*b*1 on the one side is smaller than that of the light-receiving element 83*b*2 on the other side, and the output difference corresponding to the amount of movement of the intermediate transfer belt 8 is generated. Then, when the transmissive photo sensor 83 detects such an output waveform illustrated in FIG. 6C-2, the controller 90 determines the direction of movement and the amount of movement of the arm 81. Accordingly, the direction of movement and the amount of movement of the intermediate transfer belt 8 (or the contact member 82) are obtained.

Then, when the deviation detection device 80 detects the displacement (the direction of displacement and the amount of displacement) of the intermediate transfer belt 8, the correction roller 17 and the correction mechanism 91, which constitute the correction device, corrects the displacement of the intermediate transfer belt 8 in the width direction based on the detection result. That is, the correction roller 17 and the correction mechanism 91 function as the correction device that corrects the displacement of the intermediate transfer belt 8 in the width direction based on the detection result by the deviation detection device 80.

With reference to FIG. 3, the correction roller 17 is disposed on the upstream side in the rotation direction of intermediate transfer belt 8 relative to photoconductor drums 1Y, 1M, 1C, and 1K and in contact with the inner circumference surface of intermediate transfer belt 8. With reference to FIG. 4, the correction roller 17 is configured to pivots in the directions X1 and X2 around a pivot 17*a* as a drive cam of the correction mechanism 91 operates by a predetermined angle. Specifically, the controller 90 determines the direction and angle of rotation of the drive cam of the correction mechanism 91 based on the detection result of the deviation detection device 80, thereby determining the direction and amount (or duration) of pivot of the correction roller 17 corresponding to the direction and angle of rotation of the drive cam.

With such a configuration, when the intermediate transfer belt 8 is displaced to the right in FIG. 4 (i.e., the belt deviation occurs), the transmissive photo sensor 83 detects the direction of displacement and the amount of displacement, and then, based on the detection result, the correction roller 17 pivots in the direction X2 to correct the displacement of the intermediate transfer belt 8. On the other hand, when the intermediate transfer belt 8 is displaced to the left in FIG. 4, the transmissive photo sensor 83 detects the direction of displacement and the amount of displacement, and then, based on the detection result, the correction roller 17 pivots in the direction X1 to correct the displacement of the intermediate transfer belt 8. As a result, a problem in which the intermediate transfer belt 8 meanders, and a problem in which the intermediate transfer belt 8 is broken when the intermediate transfer belt 8 is largely displaced in the width direction and in contact with other components are prevented.

As the correction device, instead of changing the position of the shaft of the correction roller 17, the actuator can be used to contact and bias the side portion of the intermediate transfer belt 8, thereby correcting the displacement of the intermediate transfer belt 8. As another example of the correction device, a portion of the casing of the intermediate transfer belt device 15, to which the tension spring 84 is coupled, may move to change the biasing force of the tension spring 84, thereby correcting the displacement of the intermediate transfer belt 8.

As illustrated in FIG. 5, the deviation detection device 80 in the present embodiment includes the wear detection sensor 85 as a wear detector that detects that the amount of wear of the contact member 82 due to contact with the intermediate transfer belt 8 as a rotator has reached a threshold Z.

Figure 7A:
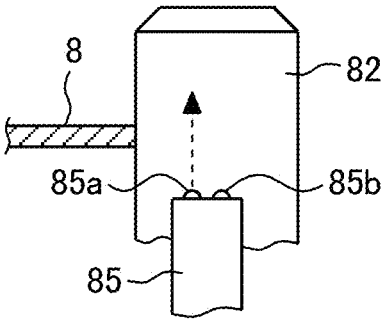
FIG. 7A is a schematic view of a wear detection sensor in a case where the amount of wear of an intermediate transfer belt has not reached a threshold.
Figure 7B:
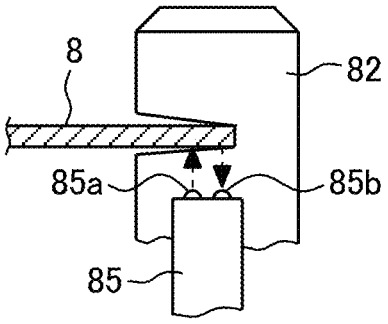
FIG. 7B is a schematic view of the wear detection sensor in a case where the amount of wear of the intermediate transfer belt has reached the threshold.

Specifically, the wear detection sensor 85 (the wear detector) is a reflective photo sensor (a photoreflector) support by the arm 81. Further, as illustrated in FIGS. 7A and 7B, the wear detection sensor 85 includes a light-emitting element 85*a* (a light source) and a light-receiving element 85*b*. The wear detection sensor 85 is disposed in the vicinity of the contact member 82, and, as illustrated in FIGS. 7A and 7B, optically detects a side end portion of the intermediate transfer belt 8 buried in the contact member 82 whose wear has progressed.

More specifically, when the contact member 82 is hardly worn as illustrated in FIG. 7A and the amount of wear has not reached the threshold Z, the side end portion of the intermediate transfer belt 8 is not deeply buried in the contact member 82. In such a case, the side end portion of the intermediate transfer belt 8 has not reached a position above the wear detection sensor 85. Therefore, light emitted from the light-emitting element 85*a* travels straight upward, and the reflected light does not enter the light-receiving element 85*b*. From the output value of the light-receiving element 85*b* at such a time, the controller 90 recognizes that the amount of wear of the contact member 82 has not reached the threshold Z.

On the other hand, when the wear of the contact member 82 has progressed as illustrated in FIG. 7B and the amount of wear has reached the threshold Z, the side end portion of the intermediate transfer belt 8 is deeply buried in the contact member 82. In such a case, the side end portion of the intermediate transfer belt 8 reaches a position above the wear detection sensor 85. The light emitted from the light-emitting element 85*a* is reflected by the surface of the intermediate transfer belt 8, and the reflected light enters the light-receiving element 85*b*. From the output value (a change in output) of the light-receiving element 85*b* at such a time, the controller 90 recognizes that the amount of wear of the contact member 82 has reached the threshold Z.

In the present embodiment, in response to an indirect detection by the wear detection sensor 85 (the wear detector) that the amount of wear of the contact member 82 has reached the threshold Z in the above manner, the controller 90 reports an abnormality in the apparatus to the user.

Specifically, when the controller 90 receives the detection of the state in which the amount of wear of the contact member 82 has reached the threshold Z, the controller 90 determines that continuing the operation of the intermediate transfer belt device 15 (or the image forming apparatus 100) can cause various kinds of problems. Therefore, the controller 90 issues and displays a notification on an operation display panel 110 (attached to the exterior of the apparatus). The notification can be the following warning message: "An error has occurred in the apparatus (error code xx). It is possible that normal printing is not available. Please contact a service person". Further, in some cases, the controller 90 can forcibly controls the image forming apparatus 100 not to operate until maintenance by a service person is completed.

As described above, the deviation detection device 80 in the present embodiment detects that the wear of the contact member 82 has progressed with the wear detection sensor 85. Thus, the deviation detection device 80 can reduce inconveniences caused by continuance of operation of the apparatus with the user not noticing such a state. Specifically, inconveniences inhibited are: errors in detection results of width-direction deviation of the intermediate transfer belt 8 by the deviation detection device 80; inaccurate correction of deviation of the intermediate transfer belt 8 (belt deviation correction) due to the erroneous detection results; and damage to the contact member 82 due to the erroneous detection results.

In particular, in the present embodiment, the intermediate transfer belt 8 is designed to rotate (run) at a high speed in a predetermined direction (the direction indicated by a solid unidirectional arrow in FIG. 5), and the contact member 82 easily wears. Therefore, a configuration for detecting wear of the contact member 82 with the wear detection sensor 85 is useful.

When the transmissive photo sensor 83 is used as the deviation detector configured to detect the displacement of the contact member 82 (the arm 81) based on the change of the output waveform of the light-receiving elements 83*b*1 and 83*b*2, the detection accuracy is likely to change greatly due to the wear of the contact member 82, as compared with the case in which a rangefinder that directly detects the displacement of the contact member 82 (the arm 81) is used as the deviation detector. Therefore, detecting wear of the contact member 82 with the wear detection sensor 85 becomes useful.

In view of the above, the "threshold Z" is set at a smaller value than a deviation amount Y (Z<Y) allowed for the intermediate transfer belt 8 in the width direction thereof (the deviation amount Y is such a deviation amount that will not cause any problem due to wear of the contact member 82).

For example, the allowable deviation amount Y in the width direction may be a value close to the limit below which no errors will occur in results of detection of deviation of the intermediate transfer belt 8 by the deviation detection device 80.

Further, as described above with reference to FIG. 4, in a case where the scale pattern 8*a* is detected by the photo sensor 95, and the rotating speed of the intermediate transfer belt 8 is controlled to be constant, if wear of the contact member 82 progresses and the intermediate transfer belt 8 is buried in the contact member 82, the scale pattern 8*a* is pushed out of a detection span M of the photo sensor 95. As a result, such speed control is not feasible.

Therefore, the deviation amount Y allowed for the intermediate transfer belt 8 in the width direction thereof may be set at a value close to the limit below which the problem of the scale pattern 8*a* moving out of the detection span M of the photo sensor 95 will not occur.

In the present embodiment, the wear detection sensor 85, which is a reflective photo sensor, uses an infrared diode as the light-emitting element 85*a* (the light source). By using an infrared diode as the light-emitting element 85*a*, the wear detection sensor 85, which is a reflective photo sensor, is less likely to have a problem of detection accuracy lowered due to the influence of disturbance light.

Figure 8A:
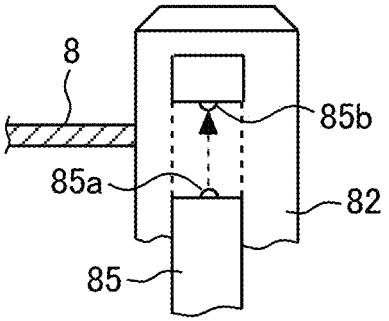
FIG. 8A is a schematic view of a wear detection sensor as a modification in a case where the amount of wear of the intermediate transfer belt has not reached a threshold.
Figure 8B:
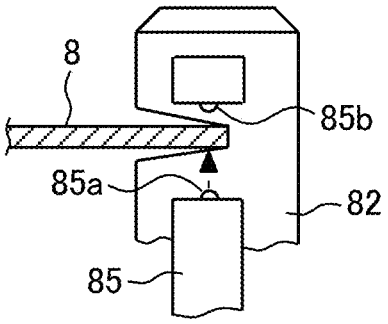
FIG. 8B is a schematic view of the wear detection sensor as the modification in a case where the amount of wear of the intermediate transfer belt has reached the threshold.

Although a reflective photo sensor (a photoreflector) is used as the wear detection sensor 85 in the present embodiment, it is also possible to use a transmissive photo sensor a photointerrupter) as the wear detection sensor 85 as illustrated in FIGS. 8A and 8B.

Specifically, as illustrated in FIGS. 8A and 8B, the wear detection sensor 85, which is a transmissive photo sensor, is held by the arm 81, and the light-emitting element 85*a* and the light-receiving element 85*b* are disposed at vertically separated positions.

As illustrated in FIG. 8A, when the contact member 82 is hardly worn, and the amount of wear has not reached the threshold Z, the side end portion of the intermediate transfer belt 8 is not deeply buried in the contact member 82, and does not reach the position of the wear detection sensor 85. Therefore, light emitted from the light-emitting element 85*a* travels straight upward, and enters the light-receiving element 85*b*. From the output value of the light-receiving element 85*b* at such a time, the controller 90 recognizes that the amount of wear of the contact member 82 has not reached the threshold Z.

On the other hand, as illustrated in FIG. 8B, when the wear of the contact member 82 has progressed, and the amount of wear has reached the threshold Z, the side end portion of the intermediate transfer belt 8 is deeply buried in the contact member 82, and reaches a position above the wear detection sensor 85. Therefore, light emitted from the light-emitting element 85*a* is blocked by the intermediate transfer belt 8, and does not enter the light-receiving element 85*b*. From the output value (a change in output) of the light-receiving element 85*b* at such a time, the controller 90 recognizes that the amount of wear of the contact member 82 has reached the threshold Z.

In a case where a transmissive photo sensor is used as the wear detection sensor 85 as described above, an infrared diode is also used as the light-emitting element 85*a* (the light source), so that detection accuracy is less likely to decrease due to the influence of disturbance light.

Further, in the present embodiment, to prevent a decrease in the detection accuracy of the wear detection sensor 85 due to toner or paper dust floating in the apparatus and adhering to the light-emitting element 85*a* and the light-receiving element 85*b* of the wear detection sensor 85, the wear detection sensor 85 may be covered with a covering member having light transmission capability, or air may be blown to the sensor surface of the wear detection sensor 85, to clean the sensor surface.

Figure 9:
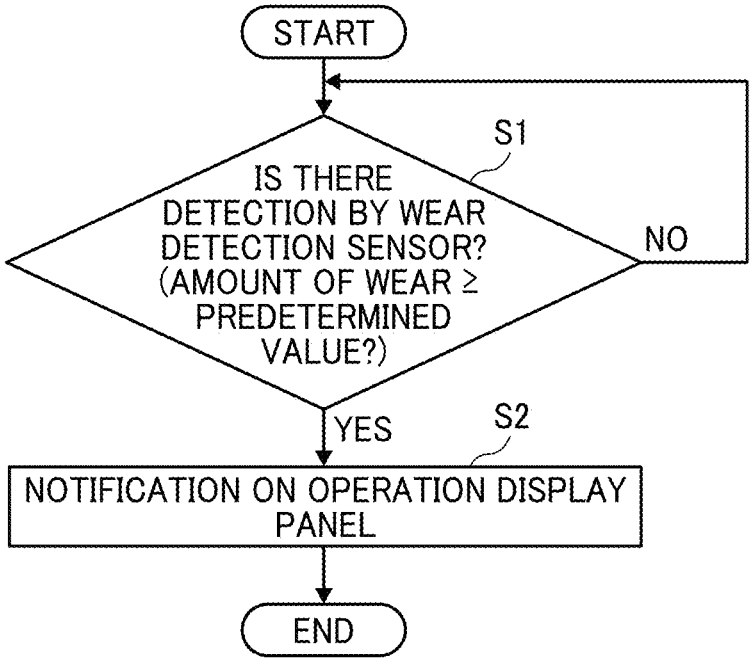
FIG. 9 is a flowchart illustrating control using the wear detection sensor, according to an embodiment.

FIG. 9 is a flowchart comprehensively illustrating the control using the wear detection sensor 85 described so far.

As illustrated in FIG. 9, when the apparatus is activated, the controller 90 constantly determines whether or not a change is present in output from the wear detection sensor 85 (step S1). In other words, the controller 90 determines whether or not the wear detection sensor 85 detects a state in which the amount of wear of the contact member 82 has reached the threshold Z (a predetermined value).

In response to the detection by the wear detection sensor 85 that the amount or wear has reached the threshold Z, the controller 90 displays a message that a problem will be caused by wear on the operation display panel 110 (step S2).

In the present embodiment, the controller 90 can be configured to determine whether the amount of wear of the contact member 82 has reached the threshold Z, from a detection result obtained by the wear detection sensor 85 (the wear detector) while the intermediate transfer belt 8 (the rotator) makes one rotation in the predetermined direction.

In other words, even if the wear detection sensor 85 detects the state in which the amount of wear of the contact member 82 has reached the threshold Z, a message "an abnormality has occurred in the apparatus" is not immediately displayed on the operation display panel 110. Instead, the controller 90 keeps monitoring the output from the wear detection sensor 85 while the intermediate transfer belt 8 makes one rotation, and a message "an abnormality has occurred and maintenance is necessary" is displayed on the operation display panel 110 only when the detection of the state continues during one rotation of the intermediate transfer belt 8.

By performing such control, it is possible to reduce the problem of erroneous detection of a state in which the amount of wear of the contact member 82 has reached the threshold Z by e wear detection sensor 85, due to the influence of local damage to the side end portion of the intermediate transfer belt 8, unexpected noise, or the like.

In a case where a wear detector is designed to directly quantify and detect the amount of wear of the contact member 82, the mean value of the amounts of wear detected by the wear detector while the intermediate transfer belt 8 rotates one cycle may be calculated, and a message to the effect that an abnormality has occurred may be displayed on the operation display panel 110 when the mean value has reached the threshold Z.

In the present embodiment, the contact member 82 is cylindrical.

As a result, the contact member 82 is in point contact with the intermediate transfer belt 8, thereby reducing the contact area between the contact member 82 and the intermediate transfer belt 8. Therefore, even in the case of runout of the intermediate transfer belt 8 in the direction perpendicular to the width direction (direction perpendicular to the surface of the paper on which FIG. 4 is drawn), the contact member 82 is unlikely to pivot due to the runout of the intermediate transfer belt 8. In addition, even if the attachment accuracy (attachment angle) of the contact member 82 relative to the intermediate transfer belt 8 varies, the detection result of the transmissive photo sensor 83 hardly varies. Furthermore, the wear due to sliding contact between the contact member 82 and the intermediate transfer belt 8 is reduced. Therefore, the displacement of the intermediate transfer belt 8 in the width direction can be detected with high accuracy over time.

In the present embodiment, the contact member 82 is formed in a cylindrical shape. However, even if the contact member 82 is not formed in a cylindrical shape, for example, if the contact member 82 is semi cylindrical, the curved contact portion of the contact member 82 can attain the same effect.

In the present embodiment, the contact member 82 is secured to the arm 81 in the non-rotational manner. Thus, unlike the case in which the cylindrical contact member 82 is rotatably mounted on the arm 81 about the central axis of the contact member 82, the detection accuracy of the transmissive photo sensor 83 is prevented from varying due to the eccentricity of the contact member 82. Therefore, the displacement of the intermediate transfer belt 8 in the width direction can be corrected with high accuracy.

With reference to FIG. 3, in the present embodiment, the drive roller 16 is disposed in the vicinity of the deviation detection device 80.

Such a configuration reduces the displacement (runout) of the intermediate transfer belt 8 in the direction perpendicular to the intermediate transfer belt 8 (the direction perpendicular to the surface of the paper on which FIG. 4 is drawn) at the position of the deviation detection device 80 (the contact member 82). That is, since the belt tension of the intermediate transfer belt 8 is increased by the drive roller 16, the displacement of the intermediate transfer belt 8 at the position of the deviation detection device 80 in the direction perpendicular to the intermediate transfer belt 8 is restricted. Therefore, the following drawback is prevented, that is, in addition to the detection component to be originally detected (i.e., the detection component in the width direction), a displacement component in a direction different from the width direction and the rotation direction of the intermediate transfer belt 8 is also detected by the deviation detection device 80. Therefore, the detection accuracy of the belt deviation of the intermediate transfer belt 8 by the deviation detection device 80 is further improved.

In the present embodiment, the correction roller 17 (a correction device) is disposed away from the deviation detection device 80. Specifically, the correction roller 17 is disposed on the upstream side in the rotation direction of the intermediate transfer belt 8 from an opposing region where the photoconductor drums 1Y, 1M, 1C, and 1K are opposed to the intermediate transfer belt 8. The deviation detection device 80 is disposed downstream in the rotation direction of the intermediate transfer belt 8 from the opposing region where the photoconductor drums 1Y, 1M, 1C, and 1K are opposed to the intermediate transfer belt 8.

As described above, since the deviation detection device 80 is disposed away from the correction roller 17, even if the correction roller 17 pivots for correction operation, regulating force (i.e., restraint force of displacement in the perpendicular direction) on the intermediate transfer belt 8 by the drive roller 16 does not decrease, thereby improving the detection accuracy of the deviation detection device 80.

Further, in the intermediate transfer belt device 15 according to the present embodiment, the deviation detection device 80 is disposed away from the opposing region where the photoconductor drums 1Y, 1M, 1C, and 1K are opposed to the intermediate transfer belt 8. Specifically, the deviation detection device 80 and the drive roller 16 are disposed downstream in the rotation direction of the intermediate transfer belt 8 from the opposing region where the photoconductor drums 1Y, 1M, 1C, and 1K are opposed to the intermediate transfer belt 8 (i.e., a position after the primary transfer process).

As a result, the intermediate transfer belt device 15 can be decreased in size as compared with the case in which the deviation detection device 80 is disposed in the opposing region where photoconductor drums 1Y, 1M, 1C, and 1K are opposed to the intermediate transfer belt 8. Furthermore, as compared with the case where the deviation detection device 80 is disposed in the above-mentioned opposing region, the maintainability of the deviation detection device 80 is improved, and a drawback is prevented that the deviation detection device 80 (the transmissive photo sensor 83) malfunctions due to the noise caused by the high voltage power supply disposed near the image forming units 6Y, 6M, 6C, and 6K.

As described above, the deviation detection device 80 in the present embodiment includes: the contact member 82 that moves with deviation of the intermediate transfer belt 8 (the rotator) in the width direction thereof; the transmissive photo sensor 83 (the deviation detector) that detects the direction of deviation and the amount of deviation of the intermediate transfer belt 8 from displacement of the contact member 82; and the wear detection sensor 85 (the wear detector) that detects a state in which the amount of wear of the contact member 82 due to contact with the intermediate transfer belt 8 is the threshold Z.

As a result, it is possible to reduce the problem to be caused by the progress of wear of the contact member 82 in contact with the intermediate transfer belt 8 (the rotator).

In the present embodiment, aspects of the present disclosure are applied to the deviation detection device 80 that detects deviation (belt deviation) in the width direction of the intermediate transfer belt 8 as a rotator. However, applications of the present disclosure are limited to the present embodiment. For example, the present invention may be applied not only to a deviation detection device that detects belt deviation of the secondary transfer belt 72 of the present embodiment, but also to a deviation detection device that detects deviation of a belt member such as a photoconductor belt, direct transfer-type transfer conveyance belt, or a fixing belt, or a deviation detection device that detects deviation in the width direction of a rotator such as a photoconductor drum or an intermediate transfer drum.

Further, in the above-described embodiments, the present disclosure is applied to the image forming apparatus 100 that forms the color image. Meanwhile, the present disclosure can also be applied to an image forming apparatus that forms only a monochrome image.

Further, in the above-described embodiment, a deviation detector such as the transmissive photo sensor 83 is configured to indirectly detect the direction of displacement (the direction of movement) and the amount of displacement (the amount of movement) of the intermediate transfer belt 8 (or the contact member 82). Alternatively, a detector can be configured to directly detect the direction of displacement (the direction of movement) and the amount of displacement (the amount of movement) of the intermediate transfer belt 8 (or the contact member 82).

Further, in the present embodiment, by detecting that the intermediate transfer belt 8 is plunged into the contact member 82 whose wear has progressed, the contact member 82 that is in contact with the intermediate transfer belt 8 (rotator) The wear detection unit (wear detection sensor 85) is configured to indirectly detect the state in which the wear amount has reached the threshold Z. However, the wear detector that detects a state in which the amount of wear of the contact member 82 has reached the threshold Z is not limited to such a form, and may directly detect the amount of wear of the contact member 82. In such a case, it is determined whether or not the amount of wear detected from moment to moment by the wear detector reaches a threshold Z.

In such configurations, effects similar to those described above are also attained.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A deviation detection device to detect a deviation of a belt in an image forming apparatus to rotate, the deviation detection device comprising:

a contact member disposed in contact with the belt in the image forming apparatus and configured to move following a deviation of the belt in the image forming apparatus in a width direction of the belt in the image forming apparatus;

a deviation detector including a first light-emitting element and a first light-receiving element, the deviation detector configured to detect a direction of the deviation and a deviation amount of the belt in the image forming apparatus based on a displacement of the contact member; and a wear detector including a second light-emitting element and a second light-receiving element, the wear detector configured to detect a state in which an amount of wear of the contact member has reached a threshold.

2. The deviation detection device according to claim 1, further comprising circuitry configured to issue a notification of an abnormality in response to a detection result by the wear detector that the amount of wear of the contact member has reached the threshold.

3. The deviation detection device according to claim 1, further comprising:

an arm including a shaft around which the arm pivots, the arm configured to support the contact member; and a biasing member configured to bias the contact member, wherein the belt in the image forming apparatus is an endless belt, wherein the biasing member is configured to bias the contact member to contact an end of the endless belt in the width direction, and wherein the wear detector is held on the arm.

4. The deviation detection device according to claim 1, wherein the wear detector includes:

an infrared diode as the second light-emitting element; and the second light-receiving element is configured to receive light emitted from the infrared diode.

5. The deviation detection device according to claim 1, wherein the threshold is smaller than an allowable deviation of the belt in the image forming apparatus in the width direction.

6. The deviation detection device according to claim 2, wherein the circuitry is configured to:

monitor an output from the wear detector while the belt in the image forming apparatus makes one rotation; and determine whether the amount of wear of the contact member has reached the threshold based on monitoring of the output from the wear detector.

7. A belt device comprising:

the deviation detection device according to claim 1; and the belt in the image forming apparatus that is a belt.

8. The belt device according to claim 7, further comprising a correction device including a correction roller and configured to correct the deviation of the belt in the width direction of the belt based on a detection result from the deviation detection device.

9. An image forming apparatus comprising:

an image forming device configured to form an image; and the belt device according to claim 7.

* * * * *